US010549342B2

(12) United States Patent
Carnelutti et al.

(10) Patent No.: US 10,549,342 B2
(45) Date of Patent: Feb. 4, 2020

(54) GUIDING UNIT FOR SLABS IN A CONTINUOUS CASTING PLANT

(71) Applicant: Danieli & C. Officine Meccaniche S.p.A., Buttrio (IT)

(72) Inventors: Guido Carnelutti, Pagnacco (IT); Fabio Vecchiet, Cervignano del Fruili (IT); Pierluigi Fabbro, S. Vito di Gagagna (IT); Stefano Puzzo, Premariacco (IT); Riccardo Conte, Ronchi dei Legionari (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 0 days.

(21) Appl. No.: 15/776,490

(22) PCT Filed: Nov. 21, 2016

(86) PCT No.: PCT/IB2016/056996
§ 371 (c)(1),
(2) Date: May 16, 2018

(87) PCT Pub. No.: WO2017/085699
PCT Pub. Date: May 26, 2017

(65) Prior Publication Data

US 2018/0326476 A1 Nov. 15, 2018

(30) Foreign Application Priority Data

Nov. 20, 2015 (IT) ..... 102015000075037

(51) Int. Cl.
*B22D 11/128* (2006.01)
*F27D 3/00* (2006.01)
(Continued)

(52) U.S. Cl.
CPC ..... *B22D 11/1287* (2013.01); *B22D 11/124* (2013.01); *F27B 9/2407* (2013.01);
(Continued)

(58) Field of Classification Search
CPC ..... B22D 11/1287; B22D 11/124; B22D 11/1281; B22D 11/1282
See application file for complete search history.

(56) References Cited

U.S. PATENT DOCUMENTS

| | | | | |
|---|---|---|---|---|
| 5,638,891 | A | 6/1997 | Fukase et al. | |
| 2003/0136543 | A1 | 7/2003 | Eisenmann et al. | |
| 2012/0043047 | A1* | 2/2012 | Springmann | B22D 11/1287 164/442 |

FOREIGN PATENT DOCUMENTS

| | | |
|---|---|---|
| EP | 2682203 | 1/2014 |
| GB | 2240608 A | 8/1991 |

* cited by examiner

*Primary Examiner* — Kevin P Kerns
*Assistant Examiner* — Steven S Ha
(74) *Attorney, Agent, or Firm* — Stetina Brunda Garred & Brucker

(57) ABSTRACT

A guiding unit for slabs comprising at least two rolls (10, 10') connected to each other and adapted to rotate along a same axis X; wherein each roll comprises a first tubular element (12) and a second tubular element (5), which is external and coaxial to axis X and to the first tubular element and removable from said first tubular element; wherein cooling channels (3, 30) are provided in each roll between said first tubular element and said second tubular element for the passage of a coolant liquid; wherein each roll comprises a respective hub at its two ends; and wherein each hub is provided with cavities communicating with the cooling channels of the respective roll so as to define a path for the coolant liquid from a first end to a second end of the guiding unit crossing said at least two rolls.

15 Claims, 4 Drawing Sheets

(51) Int. Cl.
*F27B 9/24* (2006.01)
*B22D 11/124* (2006.01)

(52) U.S. Cl.
CPC .... *F27D 3/0024* (2013.01); *F27D 2003/0042* (2013.01); *F27D 2003/0067* (2013.01)

GUIDING UNIT FOR SLABS IN A CONTINUOUS CASTING PLANT

CROSS REFERENCE TO RELATED APPLICATION(S)

The present application claims priority to PCT International Application No. PCT/IB2016/056996 filed on Nov. 21, 2016, which application claims priority to Italian Patent Application No. 102015000075037 filed Nov. 20, 2015, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention relates to a guiding unit for slabs, which can be used in a continuous casting plant, which has the function of supporting, guiding and straightening the advancing cast product.

BACKGROUND ART

Guiding rolls for slabs in continuous casting plants are subject to high wear, in particular in the part in contact with the product, and for this reason must be appropriately either maintained or replaced.

Currently the types of rolls mostly used as guides for the casting in continuous slab casting plants are:

- solid body rolls with central or peripheral cooling (PDR=Peripheral Drilled Rolls), where solid body roll means a roll in which both the part in contact with the slab and the one on which the bearings and the supports are mounted consist of an appropriately processed single piece;
- rolls with jacket keyed on a shaft by means of cotter, these rolls also having a central cooling of the shaft or a peripheral cooling on the jacket.

Disadvantageously, the solid body rolls imply high costs and long production times. In particular, being made in a single part, they require procuring raw material, cutting to size and processing the roll body. These rolls made in one piece, supported laterally by bearings, envisage being correctly cooled by making through holes in the body of the roll itself, which is currently very costly to make. Furthermore, the roll, once it has been normally worn by the continuous contact with the advancing material, must be appropriately reconditioned and then replaced, thus implying costs for machine downtime and worn material disposal.

On the other hand, the use of rolls with jacket keyed on the shaft has the disadvantage of requiring a suitable device (press) for disassembling the wear element (jacket) from the shaft in the roll. Such an operation often causes damage to the shaft and to the jacket itself.

Furthermore, in the case of rolls with jacket keyed directly onto the shaft, the type with peripheral cooling (PDR) is more efficient because the water is distributed from the channels closer to the contact surface with the hot slab; the difficulty of this configuration, however, concerns the cooling channels made in the jacket which must ensure sealing with respect to the material and interior cleanness to prevent the risk of clogging.

Finally, in case of rolls with jacket with central cooling of the prior art, a single central channel is obtained in the inner shaft. The cooling is less effective in this solution because the peripheral zones of the roll, closest to the slab, are not cooled in optimal manner. It is thus felt the need to make a slab guiding system which can overcome the aforesaid drawbacks.

SUMMARY OF THE INVENTION

It is the primary object of the present invention to make a guiding unit for slabs formed by rolls having components which are simple to make and to assemble, which allow high accuracy in the contact between the elements, which are low cost and capable of ensuring optimal cooling, of all parts of the rolls.

It is another object of the invention to make a guiding unit of slabs having an outer consumable element of the rolls which can be placed in contact with the advancing product and which can be easily and rapidly replaced in a few simple steps, thus allowing faster maintenance than the prior art and avoiding damage to the inner element of the roll at the same time.

The present invention thus suggests to achieve the objects discussed above by making a guiding unit for slabs which, according to claim 1, comprises at least two rolls connected to each other along a common rotation axis X, wherein each roll comprises a first tubular element and a second tubular element external and coaxial to axis X and to the first tubular element and removable from said first tubular element, wherein each roll comprises a respective hub at its two ends, wherein cooling channels are provided in each roll between said first tubular element and said second tubular element for the passage of a coolant liquid, wherein said cooling channels are defined by grooves made on an outer surface of the first tubular element and closed by an inner central surface of the second tubular element, wherein each hub is provided with cavities communicating with the cooling channels of the respective roll so as to define a path for the coolant liquid from a first end to a second end of the guiding unit crossing said at least two rolls, wherein a first hub of each roll comprises a first inner chamber for letting coolant liquid into the respective roll, from which first inner ducts communicating with a first outer annular channel coaxial to axis X diverge and from which second inner duets communicating with first ends of the cooling channels of the respective roll branch off, and wherein a second hub of each roll comprises a second inner chamber for letting coolant fluid out from the respective roll, in which third inner duets communicating with a second outer annular channel coaxial to the axis X converge and in which fourth inner ducts communicating with second ends of the cooling channels of said respective roll arrive.

Advantageously, the cooling channels for each roll are defined by grooves obtained exclusively on the outer surface of the first tubular element, or inner shaft, and closed by a smooth inner surface of the second tubular element, or outer jacket.

In a first variant, the cooling channels are rectilinear, picking up the current PDR design.

In a second variant, the cooling channels are helical, instead, thus making it possible to improve the roll cooling with respect to the current solutions.

As the passage ducts of the coolant liquid, generally water, are made entirely in the outer hubs, the jackets of the guiding unit are simple cylindrical sleeves which do not have any through holes for the passage of water.

With the guiding unit of the present invention, the specific design of the cooling circuit makes it possible to obtain an efficient cooling also of the end part of the rolls, guaranteeing fluid-tightness of the circuit at the same time.

As shown in the figures, the components of the rolls which may be subject to wear, i.e. the outer jackets, are made with circular section tubes or hollow cylinders. The advantage of such configuration is that they can be made in a few steps, so that the market can be supplied very rapidly.

The inside of the jacket of each roll is complementary to the inner shaft on the surface of which the cooling channels mentioned above are made. Such inner shaft, unlike the outer jacket, is not replaced because, by not coming into contact with the advancing hot product, is not subject to wear. At the same time, the inner "core" function of the roll provides rigidity to the structure, allowing optimal cooling at the same time.

Thus, both the part subject to wear and the inner shaft can be kept on stock since they are made using tubes available on the market, which can be cut to size when the need to replace a component arises. So, a modular roll, in which the hubs may be reused, can be obtained in a few simple operations, thus avoiding the need to keep fully assembled rolls on stock.

In all guiding units, the number of rolls, arranged in series, can vary from two to three, although solutions with more than three rolls are not excluded from the invention.

The guiding unit of the present invention has the following advantages:

- by, virtue of the assembly by interference between hubs and outer jacket, since no keying is envisaged between jacket and inner shaft, the jacket can be simply replaced when it is worn, while the hubs and inner tube can be reused;
- construction simplicity of the various components;
- possibility of standardizing the hubs, the jackets and the inner shafts;
- with respect to the known rolls of the prior art, jackets and inner shafts are designed to be made starting from commercial tubes which are then appropriately worked.

So, it is possible to keep tubes on stock to be simply cut to the required length, thus, reducing maintenance times and costs;

- lower manufacturing costs and shorter delivery times, given the availability of parts on stock.

The dependent claims describe preferred embodiments of the invention.

BRIEF DESCRIPTION OF THE FIGURES

Further features and advantages of the present invention will be apparent in light of the detailed description of a preferred, but not exclusive embodiment of a guiding unit for slabs, illustrated by the way of non-limitative example, with reference to the accompanying drawings, in which.

The same reference numbers in the figures identify the same elements or components.

DETAILED DESCRIPTION OF PREFERRED EMBODIMENTS OF THE INVENTION

Figure 1:
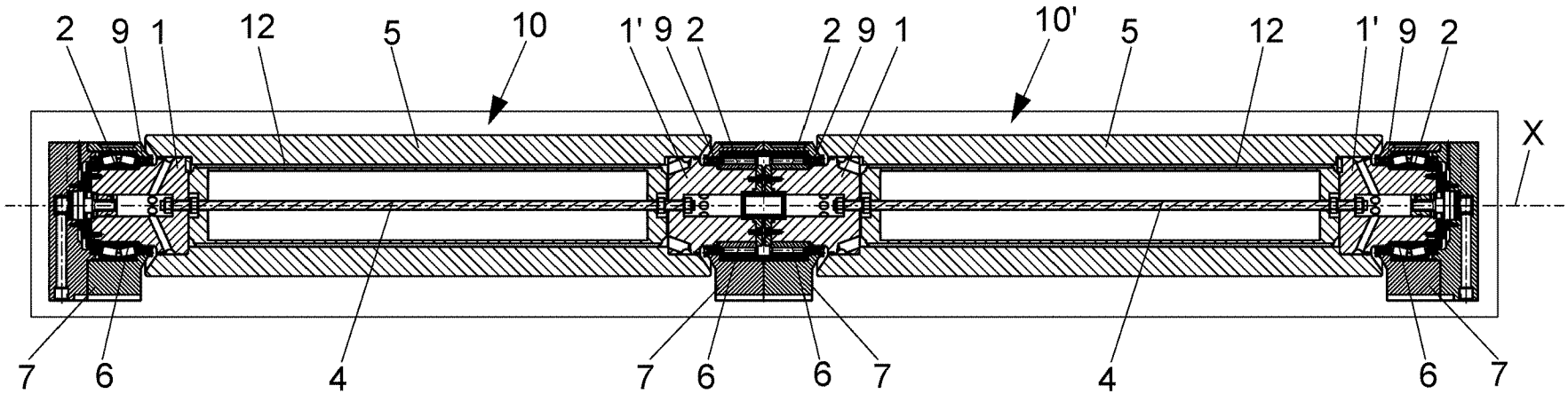
FIG. 1 is a section view of a first embodiment of the guiding unit of the invention.

Some embodiments of a guiding unit, which is the object of the present invention, for guiding and containing slabs made by a continuous casting machine are shown with reference to Figures from 1 to 9.

In all embodiments of the invention, the guiding unit comprises at least two rolls 10, 10' connected to each other along a common rotation axis X and adapted to rotate together about said axis X.

Each roll 10, 10' consists of:

- a circular section inner tubular element 12, the longitudinal axis of which coincides with axis X,
- a circular section outer tubular element 5, coaxial to axis X and to the inner tubular element 12, arranged externally and adjacent to said inner tubular element 12, and removable from the latter,
- two hubs 1, 1', each arranged at a respective end of the roll.

Cooling channels are provided in each roll 10, 10' between the first tubular element 12 and the second tubular element 5 for the passage of a coolant liquid, generally water.

Advantageously, these cooling channels are defined by grooves made on an outer surface of the inner tubular element 12 and closed by an inner central surface of the outer tubular element 5.

Figure 3:
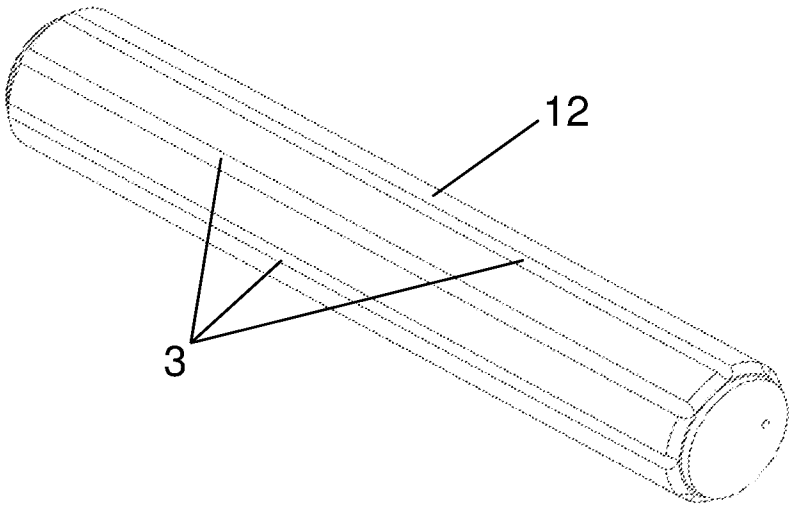
FIG. 3 is a perspective view of a component of the guiding unit in FIG. 1.

In a first variant, said grooves are longitudinal grooves 3 parallel to axis X, as shown FIGS. 1 and 3.

Figure 2:
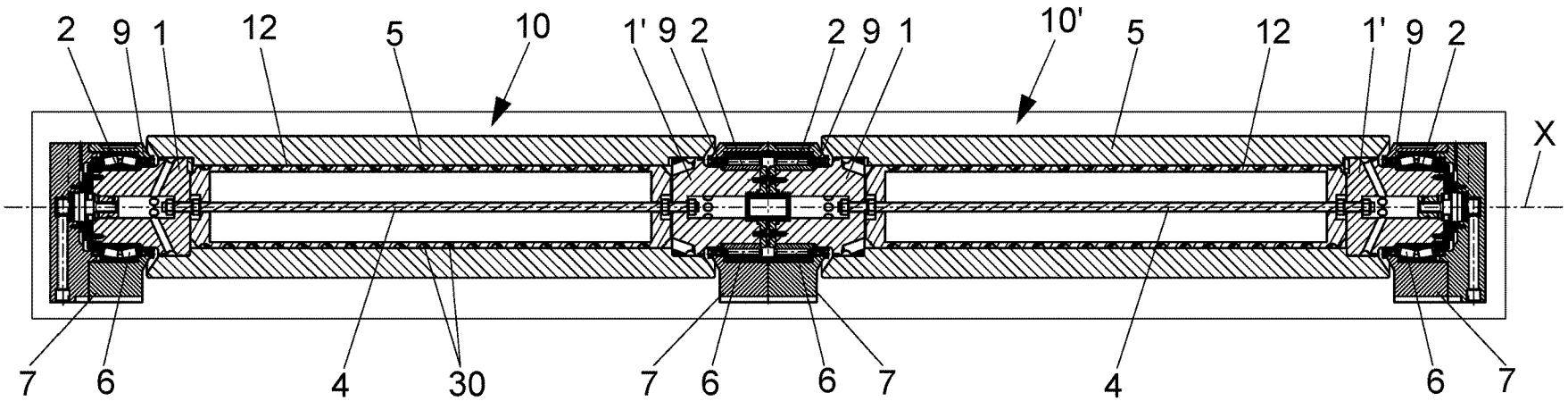
FIG. 2 is a section view of a second embodiment of the guiding unit of the invention.
Figure 4:
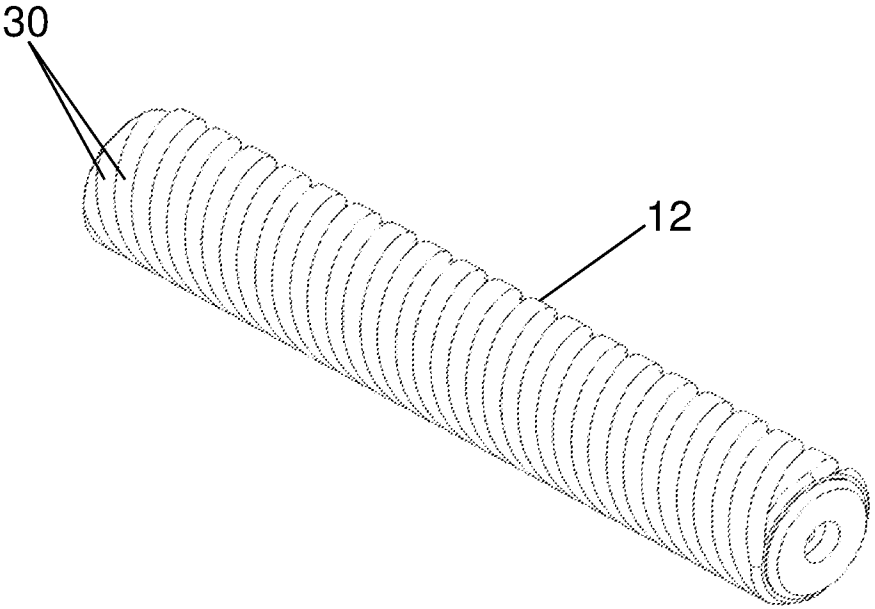
FIG. 4 is a perspective view of a component of the guiding unit in FIG. 2.
Figures 5, 6, 7:
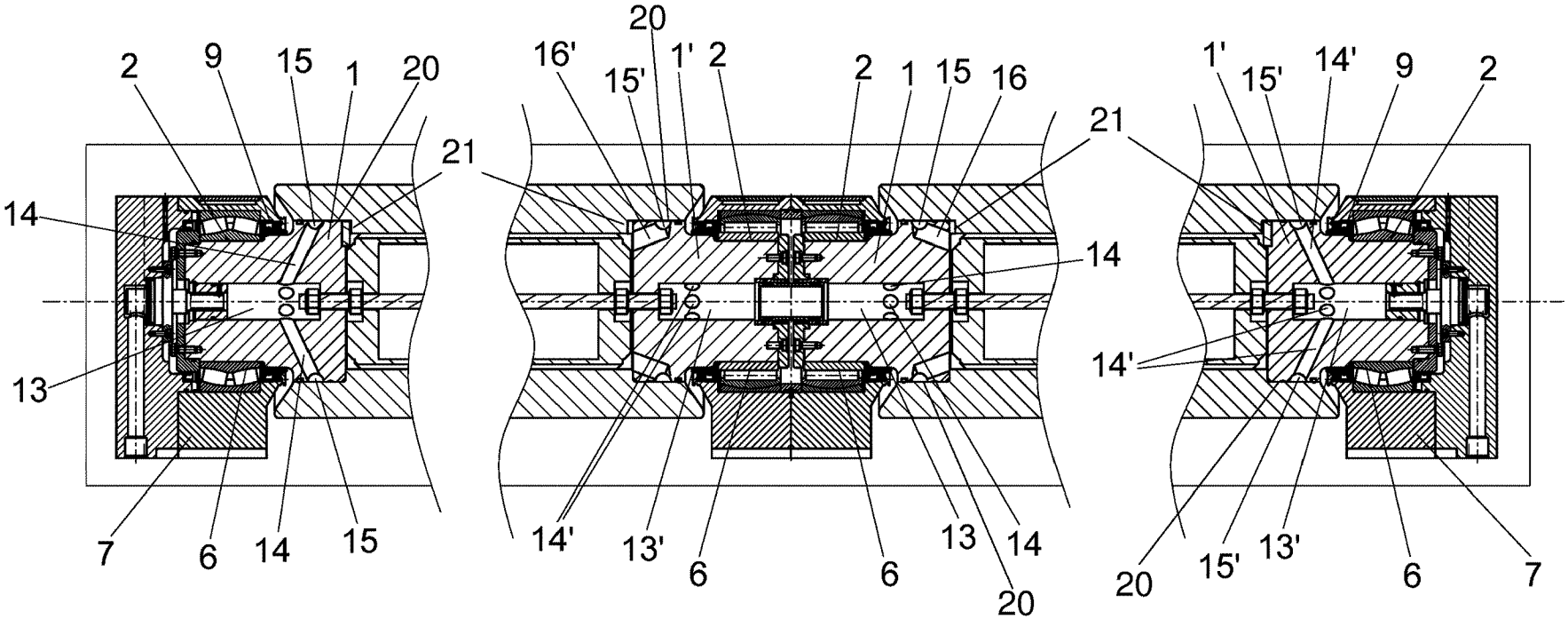
FIG. 5 is an enlargement of a first part of the guiding unit in FIG. 1.
FIG. 6 is an enlargement of a second part of the guiding unit in FIG. 1.
FIG. 7 is an enlargement of a third part of the guiding unit in FIG. 1.
Figure 9:
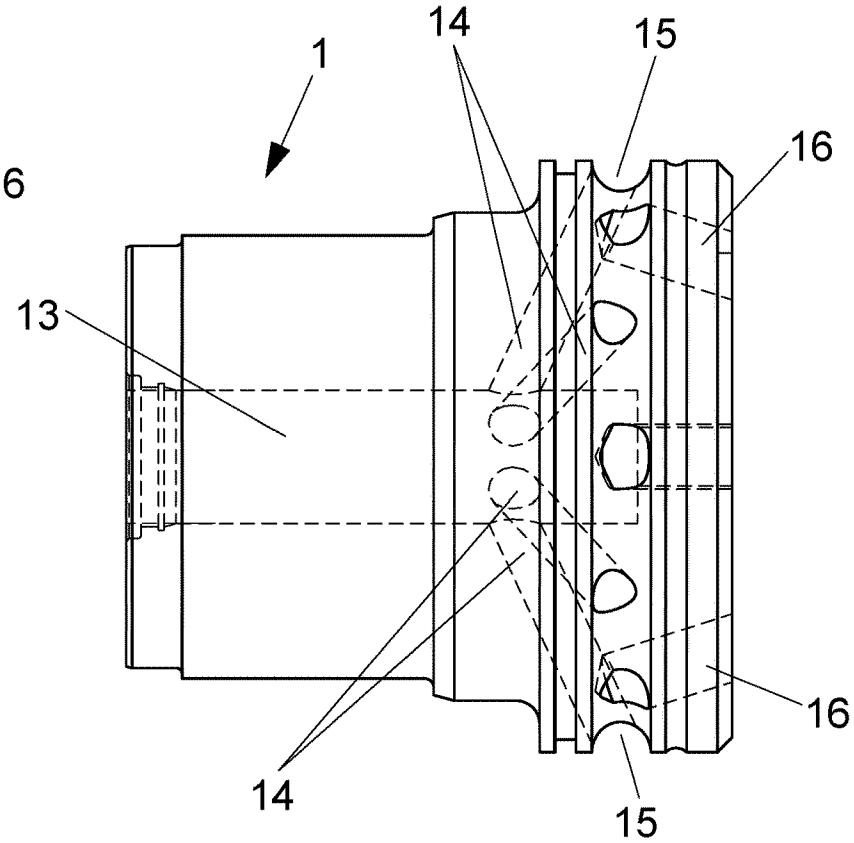
FIG. 9 is a side view of the further components in FIG. 8 with some inner technical features highlighted and indicated with dashed lines.
Figure 8:
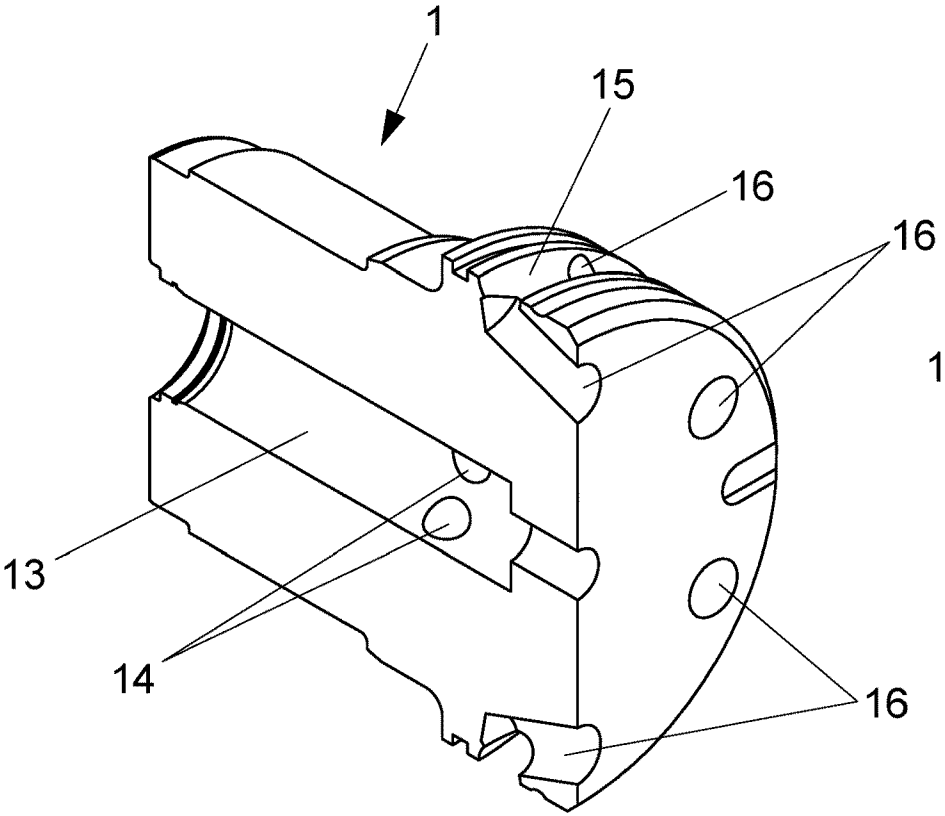
FIG. 8 is a perspective view of a half of a further component of the guiding unit of the invention.

In a second variant, said grooves are helical grooves 30 parallel to axis X, as shown in FIGS. 2 and 4.

The inner tubular element 12, or inner shaft, is preferably shaped as a hollow cylinder fixed at the ends of the respective hubs 1, 1'. For example, such hollow cylinder is crossed along axis X by a longitudinal tie rod 4 fixed at its ends to the bodies of the respective hubs 1, 1' by means of fastening nuts.

Advantageously, the outer tubular element 5, or outer jacket, is shaped as a cylindrical sleeve provided with an inner annular shoulder 21 at its ends for assembly, preferably by interference, of the hubs 1, 1' in annular end seats 20 of the sleeve delimited by the respective inner annular shoulder 21. In particular, the inner diameter of the annular seats 20 and the outer diameter of the portions of hub 1, 1' to be housed in the respective annular seat 20 are designed for fitting by interference between hubs and annular seats.

Thus, the inner shaft 12 is integrally fixed to the respective hubs 1, while the outer jacket 5 is simply inserted on the inner shaft 12 and mounted exclusively by interference with the hubs 1, 1', without envisaging neither welding to the hubs nor fitting with cotters or tabs on the inner shaft 12.

In the embodiments shown in the FIGS. 1 and 2, along axis X, the length of the inner tubular element 12 is substantially equal to the length of the outer tubular element 5 minus the length of the two annular end seats 20 for the hubs 1.

Advantageously, each hub 1, 1' is provided with cavities communicating with the cooling channels of the respective roll so as to define a path for the coolant liquid from a first end to a second end of the guiding unit, through all the rolls forming the guiding unit.

Preferably, this path comprises on an outer surface of each hub 1, 1', a respective annular channel 15, 15', coaxial to axis X, defined by an annular groove made on said outer surface and closed by a respective end inner surface of the outer tubular element 5 defining the respective annular seat 20 for the respective hub.

These outer annular channels 15, 15' are arranged in an intermediate position between the cavities or inner ducts of the respective hub 1, 1'.

Preferably, each annular channel 15, 15' is supplied by liquid coming from the inner ducts of the respective hub, which lead into said annular channel, and, in turn, supplies liquid to further inner ducts of the respective hub which branch off from said annular channel. Along each annular channel 15, 15', the liquid inlet sections are advantageously offset with respect to the liquid outlet sections. For example, said liquid inlet and said outlet sections are appropriately distanced apart along each annular channel, preferably arranged in mutually alternating manner.

In a variant of the invention, a first hub 1 of each roll comprises a first inner chamber 13 (FIGS. 5, 6, 8 and 9), preferably a central cylindrical cavity arranged along the axis X for letting coolant liquid into the respective roll.

Inner ducts 14 diverge from said inner chamber 13, which inner ducts 14 extend substantially radially to axis X towards the periphery of the hub 1, advantageously at a respective inner annular shoulder 21 of the outer tubular element 5.

Said inner ducts 14 communicate with the outer annular channel 15 coaxial to the axis X and from which further ducts 16 (FIGS. 8, 9) branch off, the ducts being internal to the hub 1 and communicating with first ends of the grooves 3, 30 of the inner tubular element 12. Thus, the annular channel 15 is in an intermediate position between the inner ducts 14 and the further inner ducts 16.

The annular channel 15 is defined by an annular groove made on the outer surface of the hub 1 and closed by the surface of the respective annular seat of the hub 1 itself.

In similar and specular manner, the second hub 1' of each roll comprises an inner chamber 13' (FIGS. 6, 7), preferably a central cylindrical cavity arranged along the axis X for letting coolant liquid out of the respective roll.

In particular, the second ends of the grooves 3, 30 of the inner tubular element 12 communicate with ducts 16' (FIG. 6), inside the hub 1 which converge into the outer annular channel 15' coaxial to axis X and from which further ducts 14' (FIGS. 6, 7) branch off, said ducts being inside the hub 1', which extend substantially radially from the periphery of the hub 1' towards the axis X and which converge in the inner chamber 13'. Thus, the annular channel 15' is in an intermediate position between the inner ducts 16' and the further inner ducts 14'.

The annular channel 15' is advantageously provided at the other inner annular shoulder of the outer tubular element 5 and is defined by an annular groove made on the outer surface of the hub 1' and closed by the surface of the respective annular seat of the hub 1' itself.

These annular channels 15, 15' are advantageously arranged in an intermediate position between the respective inner chamber 13, 13' and the cooling channels represented by the grooves 3, 30 of the inner tubular element 12.

Advantageously, the second hub 1' of each roll is arranged adjacent and specular to the first hub 1 of a further adjacent roll, if provided, in the guiding unit so that the inner chamber 13' of the second hub 1' of a first roll communicates with the inner chamber 13 of the first hub 1 of a second roll.

Considering an embodiment like the one shown in FIG. 1 or 2, i.e. with only two rolls 10, 10' forming the guiding unit, the coolant liquid enters into the, inner chamber 13 of the hub 1 of the roll 10 and through the inner ducts 14, the liquid diverges from the axis X and arrives in the annular channel 15, advantageously cooling a first end of the outer tubular element 5. From here, the liquid enters into the inner ducts 16, the inlet section of which is on the bottom of the annular channel 15, and converges in the respective first ends of the grooves 3, 30. The liquid runs in the grooves 3, 30, through the roll 10, to then converge in the inner ducts 16' of the hub 1', diverging from the axis X and arriving in the annular channel 15', advantageously cooling also the second end of the outer tubular element 5. From here, the liquid enters into the inner ducts 14 of the hub 1', the inlet section of which is on the bottom of the annular channel 15', and converges in the inner chamber 13' of the hub 1' communicating directly with the inner chamber 13 of the hub 1 of the second roll 10'. At this point, the coolant liquid repeats a path identical to that just described, crossing the second roll 10' until it exits from the guiding unit leaving the inner chamber 13' of the hub 1' of said second roll 10'.

Preferably, in each hub 1, along the outer annular channel 15, the liquid outlet sections of the inner ducts 14 are offset with respect to the liquid inlet sections of the inner duets 16. Similarly, in each hub 1', along the outer annular channel 15', the liquid outlet sections of the inner ducts 16' are offset with respect to the liquid inlet sections of the inner ducts 14'. This make it possible to optimize the cooling of the ends of the outer tubular element 5, by virtue of the recirculation of liquid throughout all the annular channel. For example, said liquid inlet and said outlet sections are appropriately distanced apart along each annular channel, preferably arranged in mutually alternating manner.

In a preferred variant of each roll, the hubs 1, 1' are mutually equal and arranged symmetrically with respect to a middle plane of the roll, orthogonal to axis X. A further advantage of the guiding unit of the invention is that the bearings 6 are mounted exclusively on housings 2 made on each hub 1, 1', with no contact with the tubular elements 5, 12 forming the rolls.

The bearings 6 may also be self-lubricating to allow the correct rotation of the roll assembly. The outer housing 7 of each bearing 6 is internally cooled so as to maintain the rotating efficacy high. Sealing means 9 are advantageously provided in each of the housings 7, between each bearing 6 and the corresponding second tubular element 5 to prevent the introduction of dust and dirt coming from the slab into the bearings.

The invention claimed is:

1. A guiding unit for slabs comprising at least two rolls connected to each other along a common axis of rotation X, wherein each roll comprises a first tubular element and a second tubular element external and coaxial to the common axis X and to the first tubular element and removable from said first tubular element, wherein each roll comprises a respective hub at its two ends, wherein cooling channels are provided in each roll between said first tubular element and said second tubular element for a passage of a coolant liquid, wherein said cooling channels are defined by grooves made on an outer surface of the first tubular element and closed by an inner central surface of the second tubular element, wherein each hub is provided with cavities communicating with the cooling channels of the respective roll so as to define a path for the coolant liquid from a first end to a second end of the guiding unit, the path crossing said at least two rolls, wherein a first hub of each roll comprises a first inner chamber for letting coolant liquid into the respective roll, from which diverge first inner ducts communicating with a first outer annular channel coaxial to the common axis X and from which branch off second inner ducts communicating with first ends of the cooling channels of the respective roll, and wherein a second hub of each roll comprises a second inner chamber for letting coolant liquid out from the respective roll, wherein third inner ducts converge in said second inner chamber, said third inner ducts communicating with a second outer annular channel coaxial to the common axis X, and wherein fourth inner ducts arrive in said outer annular channel, said fourth inner ducts communicating with second ends of the cooling channels of said respective roll.

2. The guiding unit according to claim 1, wherein said second tubular element is a cylindrical sleeve provided with an annular inner shoulder at its ends and with an annular end seat delimited by said annular inner shoulder for fitting on the respective hubs.

3. The guiding unit according to claim 2, wherein along the common axis X a longitudinal extension of the first tubular element is substantially equal to a longitudinal extension of the second tubular element minus a longitudinal extension of two annular end seats for the hubs, delimited by a respective inner annular shoulder.

4. The guiding unit according to claim 2, wherein said cylindrical sleeve is provided with an annular inner shoulder at its ends and with an annular end seat delimited by said annular inner shoulder for fitting by interference on the respective hubs.

5. The guiding unit according to claim 1, wherein the second hub of a first roll of said at least two rolls is arranged adjacent and specular to the first hub of a second roll of said at least two rolls, whereby the second inner chamber of the second hub of the first roll communicates with the first inner chamber of the first hub of the second roll.

6. The guiding unit according to claim 1, wherein the first outer annular channel and the second outer annular channel are defined by an annular groove made on an outer surface of the respective hub and closed by an inner end surface of a respective second tubular element.

7. The guiding unit according to claim 6, wherein said inner end surface defines an annular seat for the respective hub.

8. The guiding unit according to claim 1, wherein said cooling channels are defined by longitudinal grooves parallel to the common axis X.

9. The guiding unit according to claim 1, wherein said cooling channels are defined by helical grooves.

10. The guiding unit according to claim 1, wherein said first tubular element of each roll is a hollow cylinder fixed at its ends to the respective hubs.

11. The guiding, unit according to claim 10, wherein along the common axis X a longitudinal extension of the first tubular element is substantially equal to a longitudinal extension of the second tubular element minus a longitudinal extension of two annular end seats for the hubs, delimited by a respective inner annular shoulder.

12. The guiding unit according to claim 1, wherein bearings are mounted exclusively on housings obtained on each hub.

13. The guiding unit according to claim 12, wherein there are provided sealing means arranged between each bearing and the corresponding second tubular element.

14. The guiding unit according to claim 1, wherein inlet sections and outlet sections of the coolant liquid along said first outer annular channel and along said second outer annular channel are appropriately mutually spaced part.

15. The guiding unit according to claim 14, wherein the inlet sections and the outlet sections of the coolant liquid along said first outer annular channel and along said second outer annular channel are arranged in mutually alternating manner.

* * * * *